US005158178A

United States Patent [19]

Cobler

[11] Patent Number: 5,158,178

[45] Date of Patent: Oct. 27, 1992

[54] SEPARABLE CIGARETTE CARTON ASSEMBLY

[75] Inventor: Larry D. Cobler, Winston-Salem, N.C.

[73] Assignee: R. J. Reynolds Tobacco Company, Winston-Salem, N.C.

[21] Appl. No.: 725,156

[22] Filed: Jul. 3, 1991

[51] Int. Cl.[5] ..... B65D 85/10; B65D 25/04

[52] U.S. Cl. ..... 206/256; 206/271; 229/120.15; 229/120.38

[58] Field of Search ..... 206/602, 264, 271, 256, 206/242; 229/160.1, 122, 120.15, 120.38

[56] References Cited

U.S. PATENT DOCUMENTS

| | | | |
|---|---|---|---|
| 2,072,695 | 3/1937 | Wellman | 229/122 X |
| 2,605,897 | 8/1952 | Rundle | 206/264 |
| 2,783,929 | 3/1957 | Delaney | 206/273 X |
| 2,888,132 | 5/1959 | Guyer | 206/264 |
| 2,895,601 | 7/1959 | Krukonis . | |
| 3,071,244 | 1/1963 | Doran . | |
| 3,082,929 | 3/1963 | Aquino et al. . | |
| 3,086,650 | 4/1963 | Chapman et al. . | |
| 3,092,301 | 6/1963 | Selle | 206/602 |
| 3,536,246 | 10/1970 | Rosen . | |
| 3,596,758 | 8/1971 | Phillips, Jr. et al. | 206/273 X |
| 3,721,335 | 3/1973 | Grant . | |
| 3,752,308 | 8/1973 | Begemann | 206/273 X |
| 3,809,227 | 5/1974 | Begemann . | |
| 4,204,630 | 5/1980 | Focke | 229/120.38 |
| 4,631,900 | 12/1986 | Mattei et al. . | |
| 4,738,359 | 9/1988 | Phillips, Jr. | 206/256 |
| 4,773,531 | 9/1988 | Tudor et al. | 206/256 |
| 4,928,817 | 5/1990 | Focke | 206/256 |
| 4,932,534 | 6/1990 | Focke et al. | 206/602 |

OTHER PUBLICATIONS 5-pack cigarettes, *Modern Packaging*, 1947.

*Primary Examiner*—Bryon P. Gehman

[57] ABSTRACT

A cigarette carton assembly for ten packages of cigarettes can be tax stamped using automated tax machinery; and later divided into two half carton assemblies, each containing five packages of cigarettes. Each of the half carton assemblies has cigarette packages positioned therein in a two/three configuration, that is, three packages are positioned side-by-side on the right side of the carton assembly, and two packages are positioned side-by-side on the left side of the carton assembly. Each of the half carton assemblies is provided using materials which (i) provide a portion of standard and half carton assemblies, as well as (ii) function to attach the half carton assemblies together.

19 Claims, 3 Drawing Sheets

SEPARABLE CIGARETTE CARTON ASSEMBLY

BACKGROUND OF THE INVENTION

The present invention relates to the packaging of smoking articles such as cigarettes into cartons, and in particular, to the packing of packages of cigarettes into cartons such that the individual packages can be readily tax stamped.

It is common practice to ship and store cigarette packages in cartons. Conventional or standard cigarette cartons ordinarily hold ten packages, each package containing about 20 cigarettes. The packages are usually arranged in two relatively superposed rows of 5 packages each. Such standard cartons completely encase the cigarette packages and are provided with glued flaps. Examples of cartons for ten packages of cigarettes are provided in U.S. Pat. Nos. 3,752,308 to Begemann; 4,738,359 to Phillips, Jr., and 4,903,844 to Oglesby.

Individual jurisdictions require the application of a tax stamp to each package of cigarettes sold in the respective jurisdiction. Typically, the distributor or jobber in the jurisdiction receives the cartons from the manufacturer, unseals the flap of carton which is sealed with a fugitive adhesive, applies the tax stamp to each package of cigarettes, and then recloses and reseals the carton. In order to minimize the time, labor and expense associated with tax stamping of the packages within the carton, various automated tax marking or stamping machines have been developed. Such tax marking machines automatically print or otherwise affix tax stamps to packages within the carton. Tax stamping machines which are most commonly employed by distributors and jobbers include ADCO Automatic Heat Transfer Decalomanic Stamping Machine which is available from American Decal & Mfg. Co., Chicago, Ill.; Cigarette Tax Stamp Applying Machine which is available from Meyercord, Carol Stream, Ill.; and Cigarette Tax Machine which is available from Pitney Bowes, Stamford, Conn. Accordingly, the dimensions and construction of the standard cigarette carton have been established by the tax stamping machinery customarily employed by the distributors, wholesalers and jobbers who tax mark the cigarette packages prior to retail sale.

A manufacturer desiring to provide cigarette packages in non-standard size or shape cartons is forced to pay to have the individual packages hand tax stamped. Alternatively, the manufacturer can package cigarette packages in standard cartons for tax stamping and handling, and then manually load the tax stamped packages into non-standard size or shape cartons. However, a manual method for providing non-standard size or shape cartons of packaged cigarettes is time consuming, laborious and expensive.

As disclosed in *Modern Packaging*, (1947), half carton packs are provided using a three sided paperboard collar and cellophane wrap such that the bottom of the cigarette packages are exposed for tax stamping. As disclosed in U.S. Pat. No. 4,738,359 to Phillips, Jr., cigarette packages can be contained in half cartons which can be tax stamped while in a master carton and later removed from the master carton for sale. Other methods for packaging cigarette packages into cartons which are divisible into smaller units are proposed in U.S. Pat. Nos. 3,809,227 to Begemann; 4,631,900 to Mattei, et al.; 4,928,817 to Focke and 4,932,534 to Focke, et al.

Occasionally, manufacturers desire to market cartons containing five packages of cigarettes. Such cartons are similar in design to the standard cartons, but only contain 1 row of 5 packages. However, such cartons have not achieved any appreciable commercial success. In particular, five package cartons having a configuration comparable to standard cigarette cartons have had a top flap configuration. The top flap has required that the packages of such cartons be tax stamped by hand or that the tax stamped packages be manually loaded in the carton.

It would be desirable to provide a manner or method for efficiently and effectively packaging cigarettes in divisible cartons (e.g., half cartons) which in turn are provided from standard size cartons of conventional shape or configuration. In particular, it would be desirable for the cigarette manufacturer to efficiently and effectively provide cigarette packages contained within standard cartons for tax stamping using conventional automatic or semi-automatic tax stamping machinery, which standard cartons have the capability of being divisible into half cartons.

SUMMARY OF THE INVENTION

The present invention relates to carton assemblies for packaged smoking articles (e.g., cigarettes). In particular, the invention relates to a carton assembly for 10 packages of cigarettes which are arranged therein (i.e., in a 2 by 5 configuration) for transport through and tax marking using a tax marking apparatus designed for tax marking the packages within a standard carton of conventional size and shape. The preferred carton has a top portion, a bottom portion, two end portions and two side portions. A "standard carton" assembly for 10 packages of cigarettes arranged in a 2 by 5 configuration, is capable of being divided into 2 "half carton" assemblies each containing 5 packages arranged in a two/three ("⅔") configuration.

In one aspect, the present invention relates to a standard carton assembly which includes 2 half carton assemblies which are attached together. In particular, a standard carton assembly for 10 packages of cigarettes is provided by combining two half carton assemblies for 5 packages of cigarettes using material which provides a portion of the standard carton assemblies as well as the half carton assemblies. Each of the half carton assemblies have cigarette packages positioned therein in a ⅔ configuration.

In another aspect, the present invention relates to a standard carton assembly which can be divided into 2 half carton assemblies each containing 5 cigarette packages in a ⅔ configuration.

The present invention provides the manufacturer of smoking articles, such as cigarettes, with a method for packaging its product in carton assemblies which can be tax marked (e.g., using prints, decals, or the like) using conventional tax marking apparatus. Of particular interest is the fact that the divisible carton assemblies can be packaged by the manufacturer, passed through tax stamping operations, and delivered to the retailer or consumer.

DETAILED DESCRIPTION OF THE PREFERRED EMBODIMENTS

Figure 1:
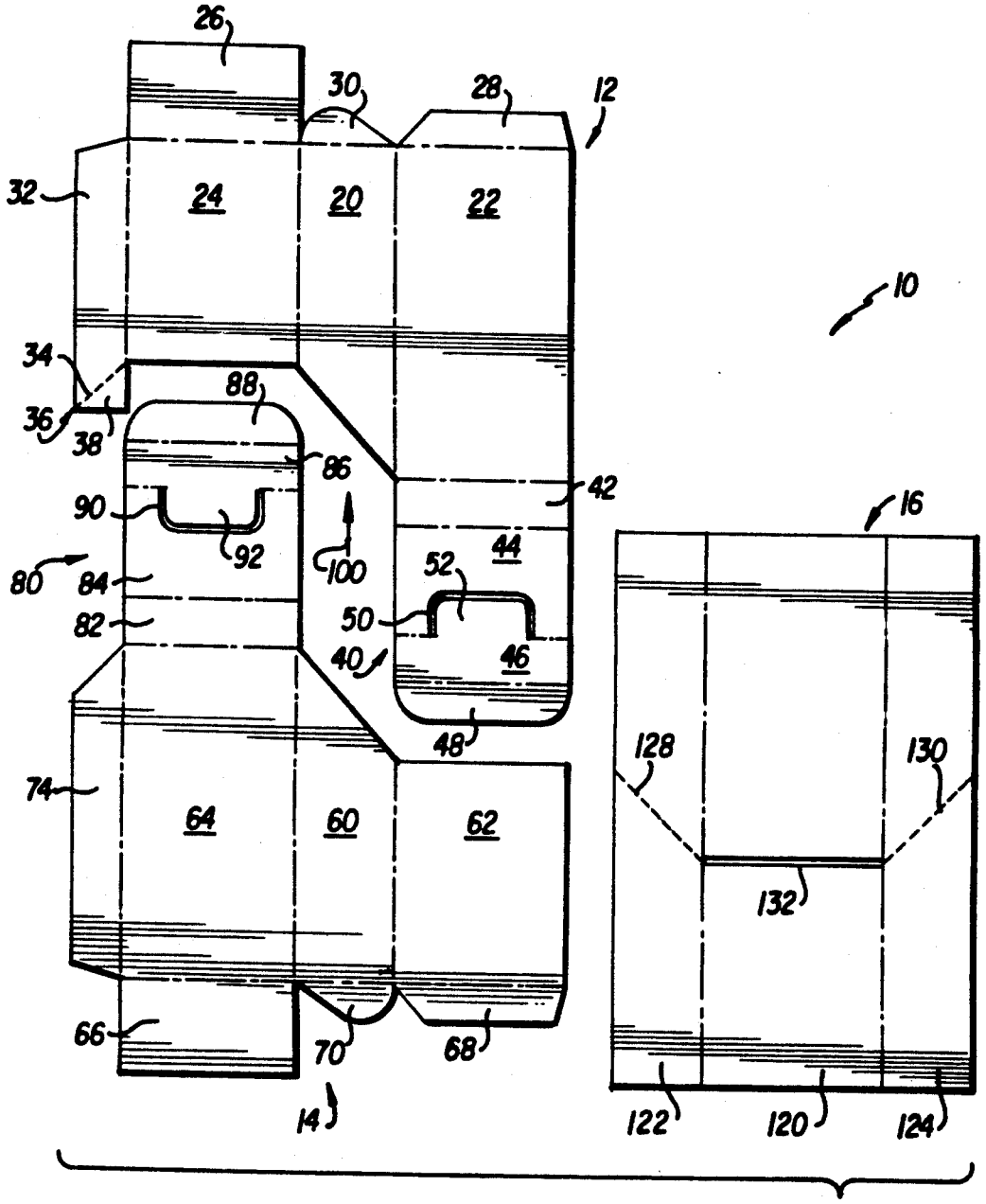
FIG. 1 is a top plan view of 3 blanks (shown in approximate scale) for making certain carton assemblies of the present invention.

Referring to FIG. 1, blank assembly 10 includes three blank portions 12, 14 and 16. Blank portions 12 and 14 are interfitting portions designed to form an assembled carton for 10 cigarette packages. Blank portion 16 is designed to (i) maintain formed interfitting blank portions 12 and 14 together as well as provide a means for separating a formed "standard carton" assembly containing 10 cigarette packages into 2 "half carton" assemblies each containing 5 cigarette packages; and (ii) provide a top flap to the formed standard and half carton assemblies.

The blank portions 12, 14 and 16 most preferably are provided from paperboard sheet, and include a plurality of fold lines, creases or score lines (shown as dash-dot lines in FIG. 1); perforations (shown as dotted lines in FIG. 1); and preferably a plurality of cuts. The degree of perforation can vary, and can be provided as to provide for the desired ease of separation of the two formed half carton assemblies which are joined to form a standard size carton into two separate half carton assemblies (as described in greater detail hereinafter). However, the degree of perforation is such that the joined half carton assemblies do not easily tear, and that the standard size carton can be handled as such. The cuts conveniently are made by slitting the blanks without necessarily removing material therefrom; however, for illustration purposes, the slit lines are shown in FIG. 1 as narrow slots. The folds, perforations and cuts of the blank portions define panels which correspond to walls, portions, sides and flaps of the carton assemblies which ultimately are constructed from those blank portions.

Blank portion 12 includes bottom portion 20 corresponding to the bottom of the carton assembly, a right side wall part 22, a left side wall part 24, and a back end wall part 26 positioned integral with and at one end of left side wall part 24. The length of left side wall part 24 is essentially equal to the width of 2 cigarette packages, the length of right side wall part 22 is essentially equal to the width of 3 cigarette packages, the width of each of side wall parts 22 and 24 is equal to the height of a cigarette package, and the width of bottom portion 20 is essentially equal to the depth of 2 cigarette packages. The blank portion 12 also includes back end flap 28 integral with and at one end of right side wall part 24, and optional reinforcing tab or "dust flap" 30 integral with and at one end of bottom portion 20. The blank portion 12 also includes top "glue flap" 32 integral with and to one side of left side wall part 24. Flap 32 extends beyond the length of left side wall part 24, and includes a perforated line 34 extending from the flap's outermost end corner 36 to the end corner of left side wall part 24. As such, adhesive region 38 is formed in the flap 32. The adhesive region 38 is shown as having a triangular shape; however, the adhesive region can have another shape (e.g., a parallelogram shape) if desired.

The blank portion 12 also includes a front end part 40 integral with and at one end of right side wall part 22. The front end part 40 includes right front end wall part 42 having a length essentially equal to the depth of a cigarette package, end left side wall part 44 having a length essentially equal to the width of a cigarette package, left front end wall part 46 having a length essentially equal to the depth of a cigarette package, and a glue flap 48. Optional cut 50 in the end, left side wall part 44 allows for the formation of tab 52 which acts to provide stability to the ultimately assembled or erected carton assembly.

Blank portion 14 is similar in many respects to the previously described blank portion 12. Blank portion 14 includes bottom portion 60 corresponding to the bottom of the carton assembly, a right side wall part 62, a left side wall part 64, and a front end wall part 66 positioned integral with and at one end of left side wall part 64. The length of left side wall part 64 is essentially equal to the width of 3 cigarette packages, the length of right side wall part 62 is essentially equal to the width of 2 cigarette packages, the width of each of side wall parts 62 and 64 is equal to the height of a cigarette package, and the width of bottom portion 60 is essentially equal to the depth of 2 cigarette packages.

The blank portion 14 also includes front end flap 68 integral with and at one end of right side wall part 64, and optional reinforcing tab or "dust flap" 70 integral with and at one end of bottom portion 60. The blank portion 14 also includes top "glue flap" 74 integral with and to one side of left side wall part 64. The back end of flap 74 is provided so that the backmost edge thereof cleanly overlaps the perforated line 34 of flap 32. The blank portion 14 also includes a back end part 80 integral with and at one end of left side wall part 64. The back end part 80 includes left end wall part 82 having a length essentially equal to the depth of a cigarette package, end right side wall part 84 having a length essentially equal to the width of a cigarette package, right end wall part 86 having a length essentially equal to the depth of a cigarette package, and a glue flap 88. Optional cut 90 in the end right side wall part 84 allows for the formation of tab 92 which acts to provide stability to the assembled carton assembly.

Blank portions 12 and 14 are designed to fit together by movement in the direction shown by arrow 100. In particular, the end edges of each of bottom portions 20 and 60 of blank portions 12 and 14, respectively, are provided so as to abut cleanly and "blend" with one another. The back end part 80 of blank portion 14 is positioned above left side wall part 24 of blank portion 12, and folded into place. The front end part 40 of blank portion 12 is positioned above right side wall part 62 of blank portion 14, and folded into place. The two portions are secured together by applying adhesive to the inside of triangular adhesive region 38 and the outside of that portion of flap 74 opposite the adhesive region 38. Each end part 40 and 80 is folded back on itself and secured firmly in place in the desired configuration or position by friction fit; or by fugitive adhesive or adhesive glue applied (i) between the glue flap 48 and the inside of a portion of left side wall part 24, and (ii) between the glue flap 88 and the inside of a portion of right side wall part 62. As such, blanks 12 and 14 are erected into a portion of the ultimate carton assembly by folding the blank along the various fold lines.

Outer blank portion 16 is designed to fit on the outside of the blank portions 12 and 14 which are secured together. The length of the outer blank portion 16 is essentially equal to that of the width of 5 cigarette packages. The width of center portion 120 is essentially equal to the height of a cigarette package, the width of left flap portion 122 positioned integral with center portion 120 is essentially equal to the depth of 2 cigarette packages, and the width of top carton portion or flap 124 positioned integral with center portion 120 is essentially equal to the depth of 2 cigarette packages. Each of flap portions 122 and 124 are perforated along angularly oriented perforation lines 128, 130, respectively. Perforation line, cut or slit line, or cut out slot 132 extends across the width of center portion 120. Cut line 132 is positioned so as to overlap the region where blanks 12 and 14 abut one another; perforation line 130 is positioned so as to overlap perforation line 34 of blank 12; and perforation line 130 is positioned so as to overlap the region where bottom portions 30 and 60 of blanks 12 and 14, respectively, abut or "blend". The blank 16 acts to attach the two half carton assemblies together as well as provide a portion of the standard carton assembly. In particular, adhesive is applied to the inner faces of center portion 120 and flap portion 122 of blank 16 so as to adhere (i) the center portion 120 to side wall part 22 of blank 12 and side wall part 62 of blank 14, and (ii) the flap portion 122 to bottom portion 20 of blank 12 and bottom wall portion 60 of blank 14. As such, blank 16 provides means for attaching the half carton assemblies together as well as a top portion of the carton assembly.

Figure 2:
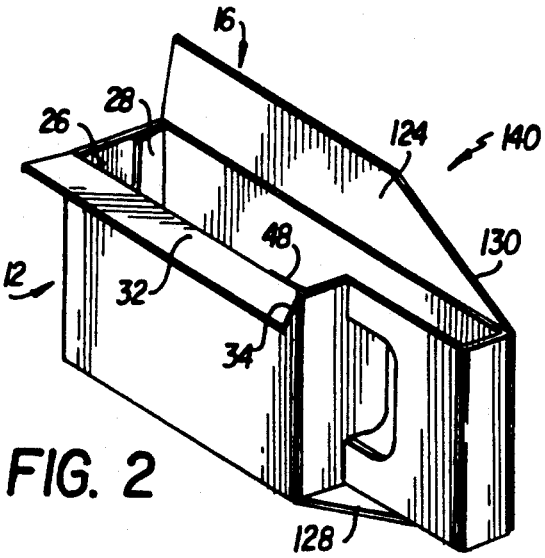
FIGS. 2 and 3 are perspective views of carton assemblies for 5 cigarette packages, the carton assemblies shown in open positions.

Referring to FIG. 2, assembled 5 package carton assembly 140 includes a portion of blank portion 12 and a portion of blank portion 16. The carton assembly is constructed from the blanks by applying adhesive to the outer faces of glue flap 48, dust flap (not shown) and back end flap 28; as well as the outer faces of bottom portion 20 and right side wall part 22. As such, blank 16 is adhered to the outer faces of the right side wall part 22 and bottom portion 20 of the erected blank 12. The triangular adhesive region on the glue flap of blank 12 (see FIG. 1) has been removed therefrom by tearing that flap along perforation line 34. The outer blank portion 16 has been perforated along lines 130 and 128 to provide the angularly extending edges of top flap 124 and bottom flap portions, respectively.

The cigarette packages (not shown) in the assembled 5 package carton assembly are arranged, configured or positioned in a ⅗ manner. That is, 3 packages are positioned side-by-side on the right side of the carton assembly, and 2 packages are positioned side-by-side on the left side of the carton assembly.

Figure 3:
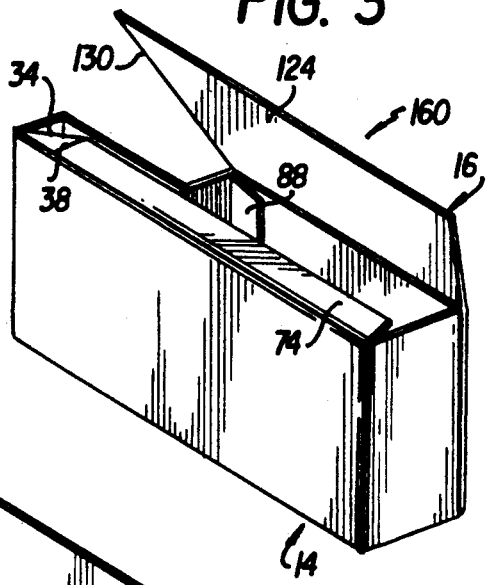

Referring to FIG. 3, assembled 5 package carton assembly 160 includes blank portion 14 and a portion of blank portion 16. The carton assembly is constructed from the blanks essentially as is the carton assembly described with reference to FIG. 2. The triangular adhesive region 38 of blank 12 (see FIGS. 1 and 2) is adhered to the outer surface of glue flap 74, and has been torn away from glue flap 32 of blank 12 (see FIGS. 1 and 2) along perforation line 34. The outer blank portion 16 has been perforated along line 130 to provide the angularly extending edge of top flap 124, and has also been perforated along the perforation line 128 on the bottom of the assembly (not shown). The cigarette packages (not shown) in the 5 package carton assembly are arranged, configured or positioned in a ⅗ manner. That is, 3 packages are positioned side-by-side on the left side of the carton assembly, and 2 packages are positioned side-by-side on the right side of the carton assembly.

Figure 4:
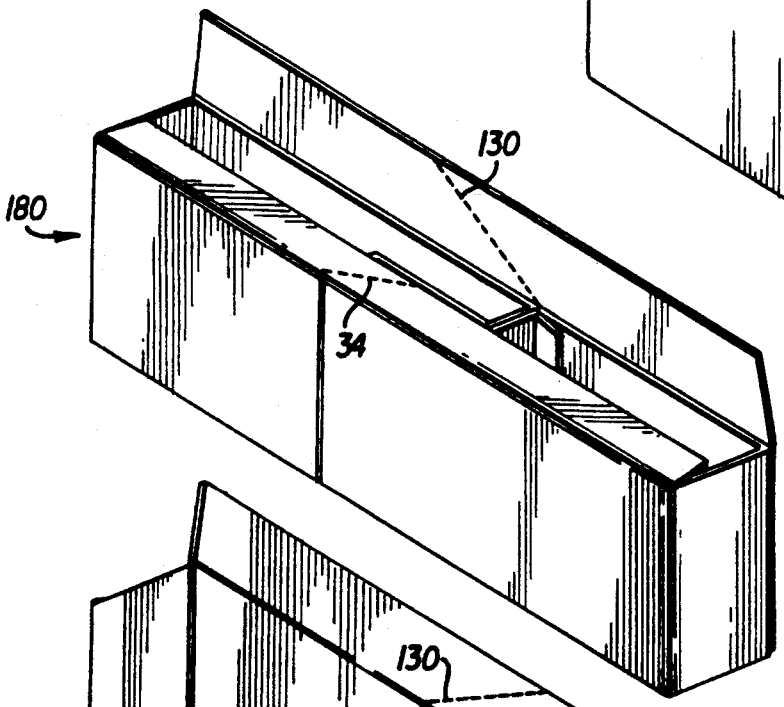
FIG. 4 is a perspective top view of a cigarette carton assembly for 10 cigarette packages, the carton assembly shown in an open position.

Referring to FIG. 4, a 10 package cigarette carton assembly 180 is provided in a form in which cigarette packages therein (not shown) are arranged in a standard 2 by 5 configuration. The carton assembly 180 includes 2 half carton assemblies which are attached together. The top of the carton assembly can be sealed using fugitive adhesive as is common in the industry. Then, the packages contained in the carton assembly can be readily tax stamped using conventional automated techniques and equipment. The carton assembly then can be sealed for further shipping and handling. The carton assembly can be marketed as such or can be readily divided into two cigarette carton assemblies (each containing 5 packages as shown in FIGS. 2 and 3) by tearing that carton assembly along perforation lines 34 and 130, as well as the other perforation lines (not shown) of the assembly. That is, the standard carton assembly includes means for dividing that assembly into two half carton assemblies.

Figure 5:
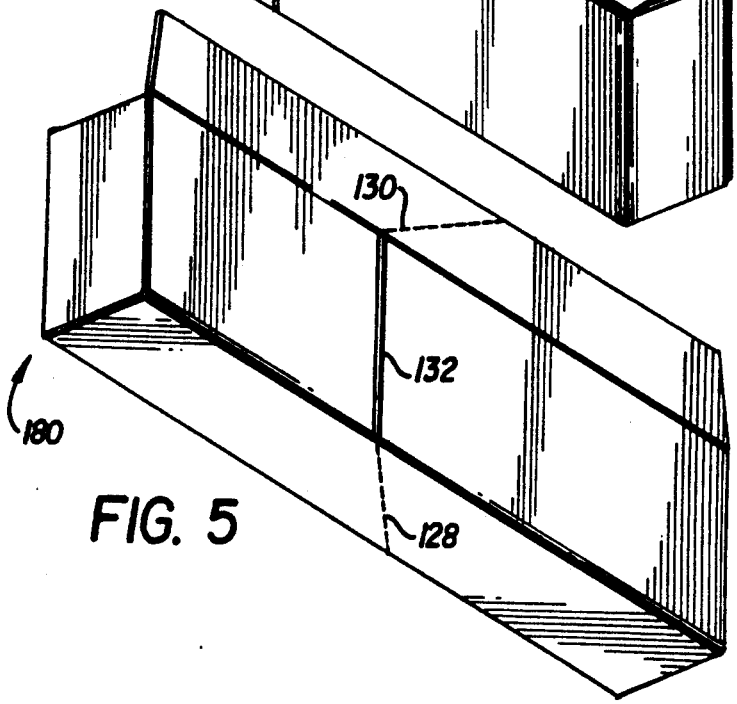
FIG. 5 is a perspective bottom view of a 10 package cigarette carton assembly for 10 cigarette packages, the carton assembly shown in an open position.

Referring to FIG. 5, the 10 package cigarette carton assembly shown in FIG. 4 can be readily divided into two cigarette carton assemblies by tearing that carton assembly along perforation lines 128 and 130, as well as the other perforation lines (not shown) of the assembly.

Figure 6:
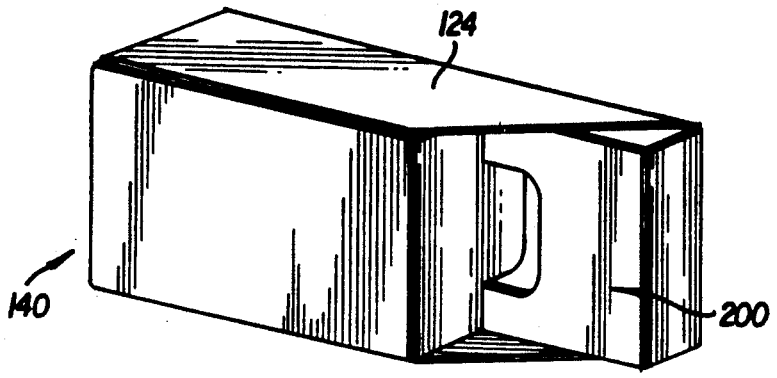
FIG. 6 is a perspective view of the carton assembly shown in FIG. 2 in a closed position.

Referring to FIG. 6, a cigarette carton assembly 140 for 5 packages of cigarettes is shown in a closed position. In particular, adhesive has been applied to the outer face of the glue flap and that flap is adhered to a portion of the inner face the top flap. The edges of the top and bottom walls of the closed half carton assembly are essentially parallel to one another; and one of the edges of each of the walls extends angularly across the respective top and bottom of the assembly from the front of the right side thereof to the front of the left side thereof. As such, the packages are effectively contained in a sealed half carton assembly, and remain securely in place within the closed or sealed carton assembly until the carton assembly is opened. The assembly so provided, containing tax marked or stamped cigarette packages (not shown), has region 200 which can be filled as desired by the cigarette manufacturer or marketer with promotional or advertising items (not shown). For example, a promotional item can be packaged in a packaging material so as to approximate the size and shape of a cigarette package which is inserted into region 200 and held in place by friction fit, adhesive glue and/or adhesive tape.

Cigarette packages can be inserted into the previously described assembled half carton assemblies, and the half carton assemblies containing cigarette packages then can be combined together into a standard carton assembly of conventional size and shape for tax stamping operations and commercial sale. Cigarette packages also can be inserted into a standard size assembly provided from two combined half carton assemblies, and then the carton assembly containing cigarettes can be subjected to tax stamping operations prior to commercial sale. The standard size carton assembly of the present invention functions in the same manner as a standard carton during tax stamping operations.

Figure 7:
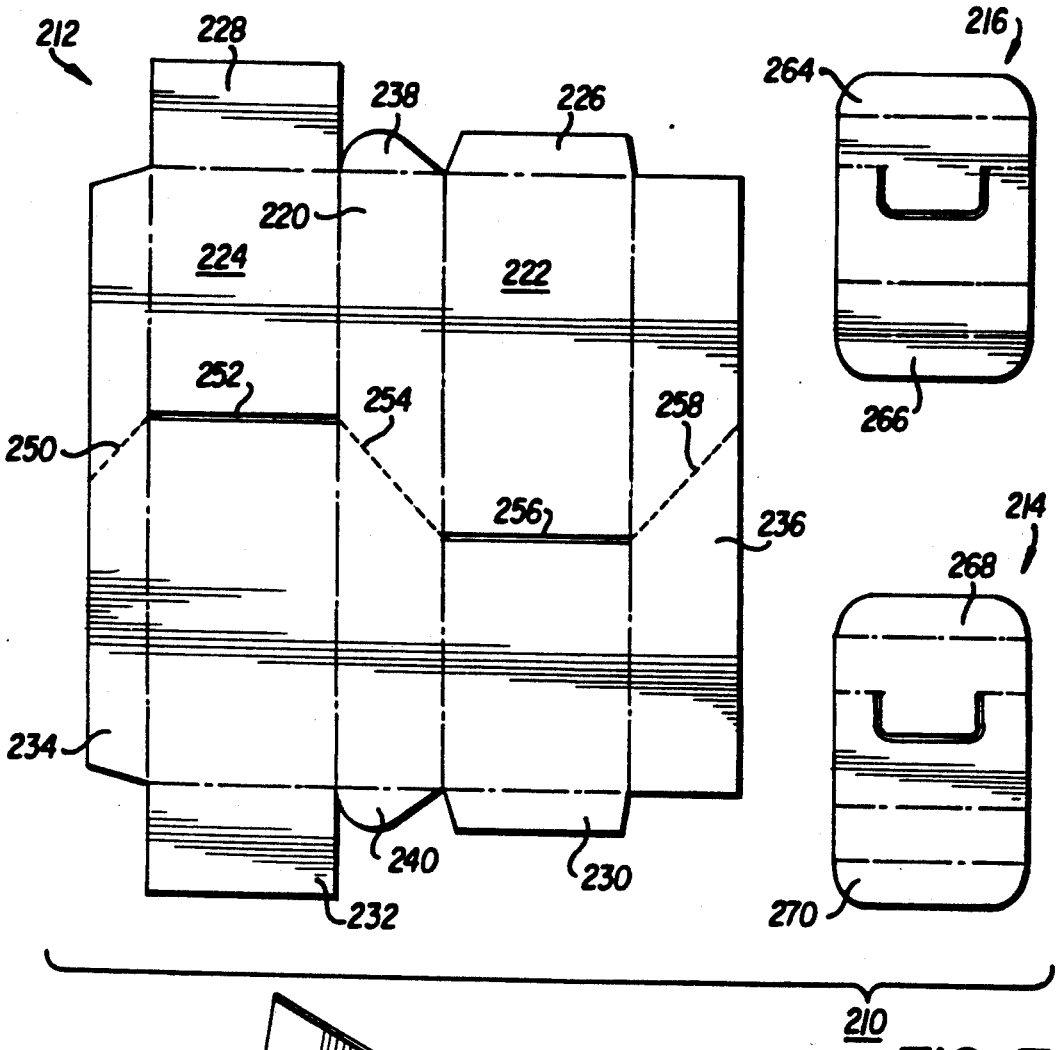
FIG. 7 is a top plan view of 3 blanks (shown in approximate scale) for making certain carton assemblies of the present invention.

Referring to FIG. 7, a less preferred blank assembly 210 includes three blank portions 212, 214 and 216. As in FIG. 1, fold lines, creases or score lines are shown as dash-dot lines; perforations are shown as dotted lines; and slit lines are shown as narrow slots. Blank portion 212 is of a construction generally similar to that of a standard cigarette carton for 10 packages of cigarettes. Blank portions 214 and 216 are designed to fit inside the standard carton which is ultimately erected from the blank portion 212.

The blank portion 212 includes bottom portion 220 corresponding to the bottom of the carton assembly; a right side wall part 222; a left side wall part 224; end wall parts 226 and 228, respectively, each positioned at one end of the blank portion and integral with each side wall part; and end wall parts 230 and 232, respectively, each positioned at the other end of the blank portion and integral with each side wall part. The blank portion includes a pair of flaps 234 and 236, integral with each of the respective side walls, which overlappingly fold together when the carton assembly is erected so as to form the inner and outer portions, respectively, of top of the carton assembly. The blank portion further includes optional reinforcing tabs or "dust flaps" 238 and 240 at opposite ends of the carton and integral with the carton bottom portion 220. The manner for erecting a carton assembly from the blank portion 212 is apparent to the skilled artisan, and involves folding the blank portion along the score lines to form a box-like enclosure. Adhesive is applied to the outside of surfaces of end wall parts 226 and 230, and those parts are adhered to the inner surfaces of end wall parts 228 and 232, respectively.

Blank portion 212 includes perforation line 250 extending angularly across flap 234, perforation or cut line 252 extending across left side wall part 224, perforation line 254 extending angularly across bottom portion 220, perforation or cut line 256 extending across right side wall part 222, and perforation line 258 extending angularly across flap 236. The perforation and cut lines are positioned so as to provide for a carton assembly which can be divided into two half cartons each having cigarette packages therein in $\frac{2}{3}$ configuration.

Blank portions 214 and 216 are essentially identical to one another in shape and size. The blank portions 214 and 216 are essentially identical to the front end part 40 of blank portion 12 and back end part 80 of blank portion 14 which are described previously with reference to FIG. 1; except that each of blank portions 214 and 216 include glue flaps 264, 266, 268 and 270, respectively, at each end thereof.

Figure 8:
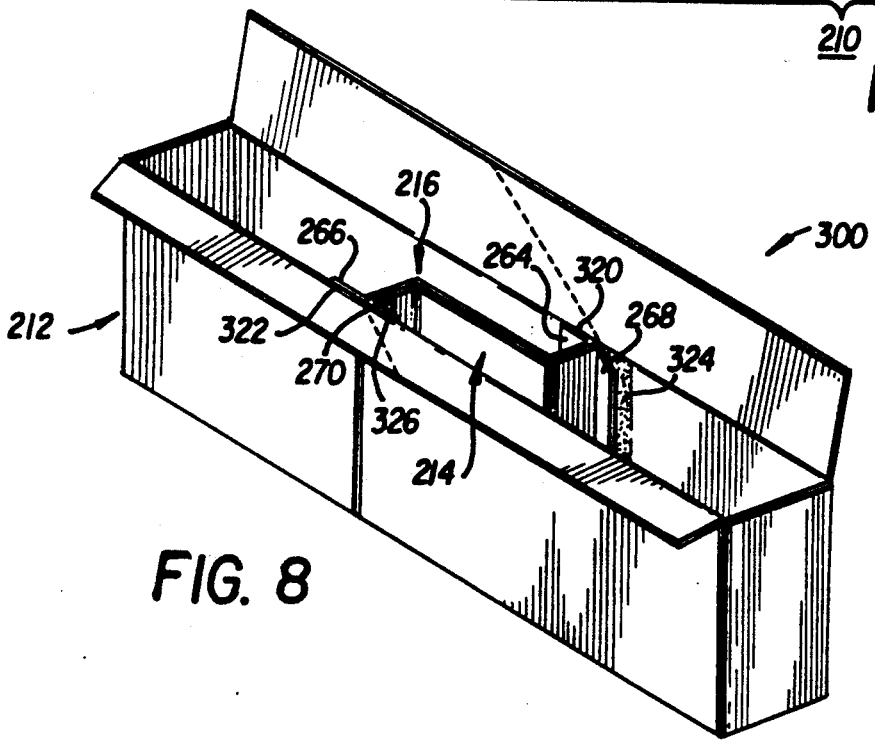
FIG. 8 is a perspective top view of a cigarette carton assembly for 10 cigarette packages, the carton assembly shown in an open position.

Referring to FIG. 8, assembled 10 package carton assembly 300 is provided in a form in which cigarette packages therein (not shown) are arranged in a standard 2 by 5 configuration. The carton assembly 300 includes the standard carton blank portion 212 which is erected to contain 10 cigarette packages; and then the two blank portions 214 and 216 are positioned therein and adhered to the inner side walls of the carton assembly by glue flaps 264, 266, 268 and 270 at regions 320, 322, 324 and 326, respectively. As such, cigarette packages contained in such a carton assembly can be subjected to tax stamping operations, and the top of the carton assembly sealed. Then, the carton assembly can be readily divided into two cigarette carton assemblies (each containing 5 packages) by tearing that carton assembly along the perforation lines thereof. The two 5 carton assemblies resemble, in many respects, the cigarette carton assemblies described previously with reference to FIGS. 2, 3 and 6.

In a much less preferred embodiment (not shown), a carton assembly is provided in much the same manner as described with reference to FIGS. 7 and 8, except that the two blank portions which are positioned within the erected carton blank portion extend entirely around the inner perimeter of the carton assembly at each respective end of that carton assembly. Although such an embodiment exhibits good stability, such an embodiment requires a significantly greater amount of materials in order to be constructed.

As used herein, the term "package" means a package comparable in size and shape to a conventional cigarette package which normally contains 20 cigarettes. See, for example, U.S. Pat. No. 4,852,734 to Allen, et al., and U.S. patent application Ser. Nos. 525,373, filed May 17, 1990 and 717,456, filed Jun. 19, 1991. The package can be a soft package or a crush proof box. Generally, a package has a height of about 70 mm to about 100 mm, and most frequently 20 rod-shaped smoking articles each having a circumference of about 22 mm to about 25 mm are arranged therein in a so called "7-6-7" or "7-7-6" configuration.

As used herein, the term "standard carton assembly" means a conventional carton assembly which is capable of containing 2 rows of 5 cigarette packages, and which most preferably is capable of being passed through commonly employed automated tax stamping apparatus. Generally, the length of a standard carton assembly is a minimum of about 266 mm and a maximum of about 286 mm. Generally, the width of a standard carton assembly ranges from about 40 mm to about 50 mm. Generally, the height of a standard carton assembly (when the top flaps are positioned such that the carton assembly is in a closed configuration) ranges from about 70 mm to about 100 mm.

An example of a preferred embodiment of this invention is as follows. A standard carton assembly has a length of about 270 mm, height of about 101 mm, width of 45 mm; and contains 10 packages of 20 cigarettes. The packages are arranged in 2 rows in a 1 by 5 fashion within the standard assembly carton. The carton assembly is manufactured from paperboard having a thickness of about 0.25 mm to about 0.30 mm. The carton assembly is provided from blank portions of the type shown in FIG. 1.

The cigarette packages within the carton assembly of the present invention can be tax stamped using conventional tax stamping apparatus. The flaps of the carton assembly can be opened, the top (i.e., exposed) side of each of the cigarette packages therein can be stamped, and the carton assembly sealed, all without the necessity of removing or rearranging the cigarette packages. Thus, the half cartons (i.e., cartons which contain 5 packages of smoking articles) can be handled and processed by the jobber or wholesaler as are conventional or standard cartons containing 10 packages of cigarettes. When the carton assembly is available for retail sale, two half carton assemblies can be provided from the standard carton and handled as such. Thus, the cigarette manufacturer can efficiently and effectively provide an inexpensive multi-pack unit of smoking articles for sale. Additionally, the manufacturer can easily provide a means for displaying and merchandising unique multi-pack units of its products.

What is claimed is:

1. A carton assembly comprising two half carton assemblies each adapted to contain five packages of smoking articles, each package having a height, a width and a depth, each half carton assembly comprising a bottom portion and two side portions, a first one of said side portions having a dimension substantially equal to two package widths, and a second one of said side portions having a dimension substantially equal to three package widths, said half carton assemblies being arranged such that the first side portion of a first one of said two half carton assemblies is substantially coplanar with the second side portion of a second one of said two half carton assemblies and the second side portions of the first half carton assembly is substantially coplanar with the first side portion of the second half carton assembly, means for separably attaching together said first and second half carton assemblies, said separably attaching means comprising a blank portion having a central portion and two flap portions connected along fold lines to the central portion, said central portion and at least one of said flap portions being affixed to said first and second half carton assemblies to hold them together and means provided in said central portion and said at least one flap portion for dividing said blank portion to thereby separate said first and second half carton assemblies, said means for dividing said blank portion comprising at least one of a cut line, slit line, perforation line or slot extending at least partly across said blank portion.

2. The half carton assembly of claim 1, further comprising two end wall portions each extending between said side portions, one of said end wall portions having first and second end wall parts arranged in spaced relation and a third end wall part connecting the first and second end wall parts.

3. The half carton assembly of claim 2, wherein said first and second end wall parts are arranged in substantially parallel planes spaced apart a distance substantially equal to a package width.

4. The half carton assembly of claim 2, wherein the other of said end wall portions has a dimension equal to two package depths, said first and second end wall parts each having a dimension substantially equal to a package depth and said third end wall part having a dimension substantially equal to a package width.

5. The half carton assembly of claim 1, wherein said two side portions each have a dimension substantially equal to a package height, said bottom portion having a dimension substantially equal to two package depths.

6. The half carton assembly of claim 1, wherein each of said two side portions is connected to said bottom portion along a respective fold line, said bottom portion having an end edge extending between said fold lines and angularly with respect thereto.

7. The carton assembly of claim 1, wherein said central portion has a dimension substantially equal to a package height and each flap portion has a dimension substantially equal to two package depths.

8. The carton assembly of claim 1, said means for dividing said blank portion comprising a cut line extending transversely across said central portion between said fold lines, and a perforation line extending angularly across each flap portion.

9. The carton assembly of claim 8, said cut line dividing said central portion into a first central part having a dimension substantially equal to two package widths and a second central part having a dimension substantially equal to three package widths, said first central part being affixed to the first side portion of the first half carton assembly and the second central part being affixed to the second side portion of the second half carton assembly, one of said flap portions being affixed to the bottom portions of said first and second half carton assemblies.

10. The carton assembly of claim 1, wherein said carton assembly has a length of about 266 mm to about 286 mm, a width of about 40 mm to about 50 mm and a height of about 70 mm to about 101 mm.

11. The carton assembly of claim 1, wherein the five packages of both half carton assemblies are grouped together to form a carton assembly arranged in a two by five package configuration.

12. The carton assembly of claim 1, wherein said means for separably attaching provides a top portion of the carton assembly.

13. A carton assembly for ten packages of smoking articles, each package having a height, a width and a depth, said carton assembly comprising top, bottom, side an end portions, and means formed in some of said portions for separating said carton assembly into two half cartons, each half carton being constructed to contain five packages of smoking articles in a two/three configuration, said side portions including first and second side portions each connected to said bottom portion along a respective fold line, said separating means comprising a first perforation or cut line extending transversely across said first side portion, a second perforation or cut line extending transversely across said second side portion, and a third perforation or cut line extending angularly across said bottom portion and intersecting said first and second perforation or cut lines, said carton assembly being transportable through a tax marking apparatus designed for tax marking packages in a standard carton so that the packages in said carton assembly can be tax marked.

14. The carton assembly of claim 13, wherein said first and second side portions are substantially planar and parallel to one another, said first perforation or cut line lying in a first plane passing perpendicularly through said first and second side portions and said bottom portion, said second perforation or cut line lying in a second plane passing perpendicularly through said first and second side portions and said bottom portion, said first and second planes being substantially parallel and spaced apart a distance substantially equal to a package width.

15. The carton assembly of claim 13, including means for dividing the interior of said carton assembly so as to contain two groups of five packages, each group being arranged in a two/three configuration, said dividing means comprising a first blank portion adhered to the inside of the first and second side portion and a second bank portion adhered to the inside of the first and second side portions, said first and second blank portions each defining a part of a respective one of said two half cartons when said carton assembly is separated into said two half cartons.

16. The carton assembly of claim 13, wherein the ten packages of smoking articles are arranged in a two-by-five package configuration.

17. A carton assembly for ten packages of smoking articles, each package having a height, a width and a depth, said carton assembly comprising top, bottom, side and end portions, and means formed in some of said portions for separating said carton assembly into two half cartons, each half carton being constructed to contain five packages of smoking articles in a two/three configuration, said side portions including first and second side portions and said end portions including first and second end portions, said side portions each having a length substantially equal to five package widths, said first and second end portions extending between said side portions and having a dimension of two package depths between said side portions, said separating means comprising a first perforation or cut line in said first side portion spaced three package widths from said first end portion, a second perforation or cut line in said second side portion spaced two package widths from said first end portion and a third perforation or cut line in said bottom portion extending angularly between said first and second perforation or cut lines, said carton assembly being transportable through a tax marking apparatus designed for tax marking packages in a standard carton so that the packages in said carton assembly can be tax marked.

18. The carton assembly of claim 17, wherein the ten packages of smoking articles are arranged in a two by five package configuration.

19. A half carton assembly for five packages of smoking articles, each package having a height, a width and a depth, said half carton assembly comprising a bottom portion and two side portions, a first one of said side portions having a dimension substantially equal to two package widths, and a second one of said side portions having a dimension substantially equal to three package widths, two end wall portions each extending between said side portions, one of said end wall portion shaving first and second end wall parts arranged in spaced relation and a third end wall part connecting the first and second end wall parts, and a tab cut from said third end wall part and extending in a plane containing the first end wall part.

* * * * *